US010738734B2

(12) United States Patent
Kiffner

(10) Patent No.: US 10,738,734 B2
(45) Date of Patent: Aug. 11, 2020

(54) HEAT CYCLE MACHINE

(71) Applicant: Yves-Michael Kiffner, Dresden (DE)

(72) Inventor: Yves-Michael Kiffner, Dresden (DE)

( * ) Notice: Subject to any disclaimer, the term of this patent is extended or adjusted under 35 U.S.C. 154(b) by 0 days.

(21) Appl. No.: 16/323,259

(22) PCT Filed: Jul. 18, 2017

(86) PCT No.: PCT/DE2017/100593
§ 371 (c)(1),
(2) Date: Feb. 5, 2019

(87) PCT Pub. No.: WO2018/028735
PCT Pub. Date: Feb. 15, 2018

(65) Prior Publication Data

US 2019/0178205 A1 Jun. 13, 2019

(30) Foreign Application Priority Data

Aug. 10, 2016 (DE) ..... 10 2016 114 788
Nov. 17, 2016 (DE) ..... 10 2016 122 156

(51) Int. Cl.
*F02G 1/05* (2006.01)
*F02G 1/043* (2006.01)

(52) U.S. Cl.
CPC ..... *F02G 1/05* (2013.01); *F02G 1/043* (2013.01); *F02G 2243/30* (2013.01)

(58) Field of Classification Search
CPC ..... F02G 1/05; F02G 1/043; F02G 2243/30
USPC ..... 60/517, 519
See application file for complete search history.

(56) References Cited

U.S. PATENT DOCUMENTS 4,653,073 A * 3/1987 Vercellotti ..... H04B 3/542 327/90
4,936,262 A * 6/1990 Paul ..... F02B 77/02 123/193.2
5,004,215 A * 4/1991 Aubry ..... B64C 27/51 180/312
5,456,076 A * 10/1995 Zornes ..... F01B 1/12 60/525
6,109,040 A * 8/2000 Ellison, Jr. ..... F01C 1/22 60/520
2007/0234719 A1 10/2007 Schuster et al.

FOREIGN PATENT DOCUMENTS

EP 2037113 A2 3/2009
WO 2012017849 A1 2/2012

* cited by examiner

*Primary Examiner* — Hoang M Nguyen
(74) *Attorney, Agent, or Firm* — Michael Soderman

(57) ABSTRACT

The invention relates to a heat cycle machine which operates according to the Stirling cycle and can be used as a multi-valent stand-alone power supply for households (electricity and heat), that is to say using various energy sources (sunlight, combustion of present materials). The heat cycle machine comprises at least one hot oil connection (4, 5) that can be connected to any desired heat source, at least one cold water connection (6, 7) and two chambers (2) that contain a working gas. The chambers (2) are connected to one another via at least one working gas line (18, 20) in which is integrated a working rotor (13) that can be driven by the working gas which is alternately heated in one of the chambers (2) and cooled in the other chamber (2).

10 Claims, 3 Drawing Sheets

HEAT CYCLE MACHINE

CROSS REFERENCE TO RELATED APPLICATIONS

This application is the U.S. national stage of International Application No. PCT/DE2017/100593, filed on Jul. 18, 2017. The international application claims the priority of DE 102016114788.5 filed on Aug. 10, 2016 and the priority of DE 102016122156.2 filed on Nov. 17, 2016; all applications are incorporated by reference herein in their entirety.

BACKGROUND

The invention relates to a heat cycle machine which operates according to the Stirling cycle and can be used as a multi-valent, that is to say using various energy sources (sunlight, combustion of available materials), stand-alone power supply for households in order to generate electricity and heat, particularly suited as isolated application.

State-of-the-art heat cycle machines are known to be based on the Stirling engine, which has been developed and optimized over more than a century using increasingly modern materials. These machines together are based on the principle of circular process work as calculated in advance by Gustav Schmidt in the 1870s, taking into account dead volumes, different loading pressures, various temperature differences, running speeds and much more.

The well-known design of Stirling engines, in which displacement and working pistons are coupled mechanically, e.g. by means of a linkage, was largely retained in the course of optimization. The Ringbom engine and the latest low-temperature Stirling engines are an exception.

The conversion of thermal energy into mechanical work using pistons necessarily entails a cyclic acceleration and deceleration of the piston mass, as a result of which the efficiency is reduced. DE 10 2008 048 633 B4 and DE 10 2008 048 639 B4 describe a piston-less system, which operates according to the Stirling principle, wherein two chambers, being alternately cooled and heated, are each connected via a fluid line to a turbine driven by the working gas flowing back and forth between the two chambers.

EP 2 037 113 A2 furthermore discloses a heat engine having two displacement pistons in two chambers, each having different temperature-controlled sides, which displacement pistons convey a working gas to a piston of a working machine. Both chambers arranged next to one another have a double-walled construction with cooling or heating media circulating therein. The vertically moved displacement pistons are coupled, for example by means of a control chain.

A further problem of, in particular, heat cycle machines operating under boost pressure is their tightness, since—due to the design principle of the machines—the working gas (mostly helium) constantly leaks and therefore has to be refilled accordingly. The torque which is eventually to be converted into electrical or mechanical power, is taken off the heat cycle machine by means of a generator, pump or the like mounted on the working shaft; that is to say that the constantly rotating shaft must be sealed in a helium-tight manner at the position, at which it is led out of the machine housing. The only exception to this principle is the use of a linear generator for power generation, which is integrated directly into the wall of a working cylinder, wherein in this case, however, moving pistons are used again.

In order to gain a considerable amount of mechanical energy, a high temperature gradient, high charging pressures and the resulting high demands on the materials, which themselves cannot be lubricated, are required. The costs are correspondingly high for a machine that is usually permanently mounted on a dedicated energy source in order to be optimized.

SUMMARY

It is the objective of the invention to provide a cost-effective, long-life and low-maintenance heat cycle machine for supplying power to a household, for example, with which an efficient conversion of heat from any external heat source is to be made possible, wherein a gradual leakage loss of working gas is to be avoided. The objective is achieved by a heat cycle machine having the characterizing features according to patent claim 1; expedient embodiments of the invention can be found in the dependent claims.

DETAILED DESCRIPTION

In accordance with the disclosure, a hermetically sealed heat cycle machine is provided to be used as a decentralized energy supply, the heat cycle machine comprising two chambers, designed as divided double wall vessels (i.e. displacement cylinders), the double wall of which is flowed through in each case by hot oil or water, two displacement pistons working in opposite directions and a working rotor which is flowed through radially, wherein all moving parts are arranged in a closed, in particular hermetically sealed, housing.

The heat cycle machine has, as is generally known, a chamber arrangement comprising two cylindrical chambers with essentially identical volume. Each of the chambers is enclosed by a double-walled chamber housing constructed of two thermally insulated partial housings, each comprising an inner and an outer housing wall. The inner and outer housing walls of each partial housing form a cavity through which a heat fluid can flow. For this purpose, each of the partial housings has in its outer housing wall a heat fluid inlet for introducing a heat fluid into the cavity formed between the inner and outer housing walls. Further, each of the partial housings has in its outer housing wall a heat fluid outlet for removing, i.e. draining, the heat fluid from the cavity.

By introducing a hot heat fluid (e.g. 300° C. hot oil) into the double wall of the first partial housing and a cold heat fluid (e.g. water with a temperature of less than 50° C.) into the double wall of the second partial housing, a hot as well as a cold zone are formed in the chamber, wherein hot and cold zone are separated spatially.

Furthermore, the heat cycle machine comprises one or (preferably) a plurality of working gas supply lines running from each chamber to a rotor housing enclosing the working rotor. Said supply lines can be closed by a valve. Additionally, the heat cycle machine comprises one or (preferably) a plurality of working gas discharge lines running from the rotor housing to the chambers, wherein a shut-off valve is introduced into the working gas discharge line before it enters each of the chambers. Said working gas discharge line is formed as a hollow cylinder extending between the two chambers along the rotational axis of the working rotor, whereby the working rotor is rotatably mounted on the working gas discharge line, e.g. by means of roller bearings. At the position where the rotor is arranged, openings (i.e. cut-outs) are provided in the working gas discharge line so that the working gas flowing out of the rotor can flow radially into the working gas discharge line.

Within each of the chambers there is a displacement piston which is permeable to the working gas and whose (cross-sectional) diameter is smaller than the inner diameter of the chamber. Preferably the diameter of the displacement piston is only slightly smaller than the inner chamber diameter in order to keep the flow cross-section small for the working gas flowing along the inner chamber wall. The length of the displacement piston preferably is approximately half the length of the chamber. Thus, the displacement piston can (almost) completely fill the hot or cold zone within a chamber, so that a working gas in the chamber is forced from one zone of the chamber into the other, i.e. the region not filled by the displacement piston.

According to the invention, both cylindrical chambers are connected by a hydraulic line which is arranged in each case on one of the chambers end faces; the hydraulic line can be closed by means of a shut-off valve. Each displacement piston is rigidly connected to a thrust piston which is movably arranged in the hydraulic line, wherein the thrust piston seals tightly with the inner wall of the hydraulic line, in that it seals the latter against the chamber.

In this case, the chambers, the thrust piston, the working gas supply lines, the working gas discharge lines and the rotor housing all together form a hermetically sealed working gas space. Any leakage of working gas into the hydraulic line, i.e. past the thrust piston, does not impair the tightness, since the hydraulic line is connected only to the chambers.

The mode of operation of the heat cycle engine is as follows:

A heat fluid heated by an external heat source, e.g. an oil or gas burner, a wood gasifier or a solar parabolic trough, is passed through the first partial housing of each chamber, whereas a cold heat fluid, e.g. a coolant, is passed through the second partial housing. Thus, a hot and a cold zone is formed within each chamber.

The displacement pistons oscillate back and forth in the chambers between these two zones, i.e. between hot and cold zone, wherein one of the displacement pistons is located, for example, in the hot region of its chamber, and at the same time the other displacement piston is located in the cold region of its respective chamber. Due to the coupling via the hydraulic line and the thrust piston, the displacement pistons move almost simultaneously into the respective other region of their chamber, wherein a predefined time delay until the individual displacement pistons are moved is made possible by closing and opening the shut-off valve in the hydraulic line. That is to say, the displacement pistons can only be displaced from a first region, e.g. the hot zone, of the chamber into the other region, e.g. the cold zone, when the shut-off valve in the hydraulic line is opened.

The working gas residing in the hot zone of a chamber is heated and thus is expanding. This expansion is accompanied by an increase in pressure as the chamber volume remains constant. By appropriately opening the valves of the working gas supply lines conveying the working gas from the chamber into the working rotor housing and closing the valve of the working gas discharge line connected to the chamber, the hot working gas flows—if necessary through the gas-permeable displacement piston or between the housing wall and the displacement piston—into the working rotor housing, where it drives the working rotor. Hereafter, the working gas flows into the cold zone of the other chamber.

The heated working gas in the same way acts upon the thrust piston pressing it into the hydraulic line. By closing the shut-off valve of the hydraulic line this increasing pressure (temporarily) is not transferred to the other displacement piston. After a certain period of time, e.g. when the mass flow of the hot working gas to drive the working rotor decreases, the shut-off valve of the hydraulic line is opened so that both displacement pistons move to the other zone of their chamber.

According to the movement of the displacement pistons, the working gas in the chambers is forced into the respective other region, i.e. the hot working gas migrates into the cold region and the cold working gas located in the other chamber migrates into the hot region of its chamber. The still hot working gas is cooled down during the passage through the displacement piston, which consists of a regenerator material, i.e. the piston can store heat energy, while the (still cold)) working gas in the other chamber is preheated during passage through the displacement piston. The preheated working gas is further heated in the hot zone of the chamber, while the working gas in the other chamber is further cooled in the cold zone thereof.

As a result, the pressure conditions in the chambers are changed. In the chamber that was previously under high pressure, the gas pressure decreases, while the gas pressure in the other chamber increases due to the heating of the working gas. Now the valves of the working gas supply lines leading from the chamber with the high pressure to the rotor housing are opened (the valves of the working gas supply lines of the other chamber were previously closed) and the valve of the working gas discharge line to the chamber (with the now high pressure) is closed and the valve to the other chamber, which now is under low pressure, is opened. Thus the working gas flows—if necessary, through the gas-permeable displacement piston or between the chamber wall and the displacement piston into the working rotor housing, where it drives the working rotor, and from there finally into the cold zone of the other chamber.

Due to the cyclic flow of working gas between the two chambers, the working rotor is constantly driven, whereby the driving force for driving the working rotor also fluctuates cyclically due to the individual cycles.

Permanent magnets may be mounted on the working rotor, whereby a stator arranged in the working rotor housing may have induction coils. This makes it possible to generate electricity directly within the rotor housing by means of induction, so that a rotating shaft guided to the outside can be omitted.

An advantage of the heat cycle machine according to the invention is thus its hermetic sealing due to the closed construction, i.e. all the movable parts including the generator remain in the interior of the machine. Only the power lines of the generator are led out of the housing to the outside.

A further advantage is the multivalence of the heat cycle machine due to the possibility of connecting it to a hot oil circuit of an existing heating device, for example oil or gas burners, wood gasifier, solar parabolic trough, etc., wherein any heat energy sources can be connected and even changed, so that any available energy source—depending on local conditions—can be used. In addition, the waste heat arising from the cooling of the working gas can be used for, for example, a hot water heater.

By designing the displacers as pistons, a short dwell time at the dead centers (i.e. end positions of the cyclic back and forth movement) is ensured, enabling more efficient heating or cooling of the working gas. In addition, the residence time of the displacement pistons at the dead centers can be controlled by means of the shut-off valve of the hydraulic line.

In addition, the mechanical efficiency is increased by using a working rotor (i.e. eliminating the working piston principle) and by avoiding the contact of the displacement pistons to the chamber housing walls.

The heat cycle machine is also characterized by a long service life, as maximum temperatures and pressures can be dispensed with, which means that less maintenance is required due to the lower material load.

The invention can also be designed in such a way that the displacement piston is movably mounted by means of wheels running, for example, on three rails arranged inside the chamber on its inner wall. Here the rails are advantageously interrupted in the middle of the chamber, i.e. they do not run continuously from one end face to the opposite end face of the chamber, so that each wheel always runs on one rail over its entire running length, but no heat transport is possible within the chamber via the rails from the hot to the cold zone. By using this wheel-rail system, the friction forces between the displacement piston and the inner wall of the chamber are greatly reduced, so that the mechanical efficiency is improved.

Furthermore, it can be provided that the working rotor comprises two pairs of circular disk-like plates arranged parallel to one another, wherein flow channels extending spirally from the outer edge to the center are formed between the plates of each pair. Thus, the working gas flowing through these flow channels is rotating the rotor.

In an advantageous way, permanent magnets are arranged on each pair of rotor plates, e.g. on the outside facing the other pair of rotor plates. The permanent magnets may be glued to the rotor plates. A stator in the form of a circular plate can be arranged between the two pairs of rotor disk-like plates, whereby the stator plate can comprise induction coils (distributed in its interior or mounted on its surface) to generate electrical current. Thus the electric current can be generated inside the rotor housing so that no rotating shaft is to be led out of the rotor housing—the rotor housing remains hermetically sealed.

To reduce the dead space for the working gas, the invention can be designed in such a way, that the number of working gas supply lines from a chamber to the rotor housing corresponds to the number of flow channels of a rotor plate pair, the flow channels running spirally from the outer edge to the center of the rotor. In particular, the connections for the working gas supply lines to the rotor housing can be arranged—separated by uniform distances from each other—on a circle on the end face of each chamber.

According to one embodiment, the working rotor is supported by means of at least two ball bearings, for example two angular ball bearings in the O-design having a pressure angle of e.g. 10°, on the working gas discharge line, wherein the wall of the working gas discharge line is interrupted radially by slightly centripetal-oriented laminar profiles, i.e. the working gas discharge line comprises in the region of the working rotor, for example between the plates of each pair of rotor plates, openings which run in a spiral shape from the outer wall to the inner wall of the working gas discharge line. As a result, the working gas can flow unbraked and laminar from the flow channels of the working rotor into the working gas discharge line, wherein the flow channels extend spirally from the outer edge to the center of the rotor. As well, the working gas can flow at a high speed (below sound velocity) and a high swirl effect through the interior of the working gas discharge line back into the respective chamber via the respectively opened shut-off valve. The high speed ensures high momentum of the gas and thus a good degree of filling of the chambers.

The invention can also be designed in such a way that the inner side of each chamber facing the working gas space, i.e. the inner housing wall, has a roughened or coarse-grained surface in order to increase the area that can be used for heat transfer.

In addition, it may be provided that the inner housing walls on the end faces of the chambers have bulges directed towards the inside of the chambers, e.g. rod-shaped bulges, through which the heat fluid, which is led through the double-walled housing wall of the chambers, can flow. The displacement pistons have recesses of the same size and shape at the corresponding positions, so that the bulges of the inner wall of the housing are "driven" almost exactly into the recesses of the displacement pistons during the oscillating movement of the displacement pistons during operation of the heat cycle machine. This design feature also increases the effective area usable for heat transfer from the chamber housing wall to the working gas.

According to one embodiment, the displacement pistons consist essentially of an open-pore metal or ceramic foam, the pore size of which continuously decreases from the edge to the center of the piston. It can also be provided that the cylinder barrel of the cylindrical piston is of solid design, whereas an open-pored metal or ceramic foam is arranged within the solid cylinder barrel. The pore size of the foam may continuously increase from the cylinder casing to the longitudinal cylinder axis, that is to say the pores located in the center are larger than the pores located at the edge.

BRIEF DESCRIPTION OF THE DRAWINGS

The invention is explained in more detail below on the basis of an exemplary embodiment in light of the accompanying drawings, wherein identical or similar features are provided with the same reference symbols.

DETAILED DESCRIPTION OF THE PREFERRED EMBODIMENTS

Figure 1:
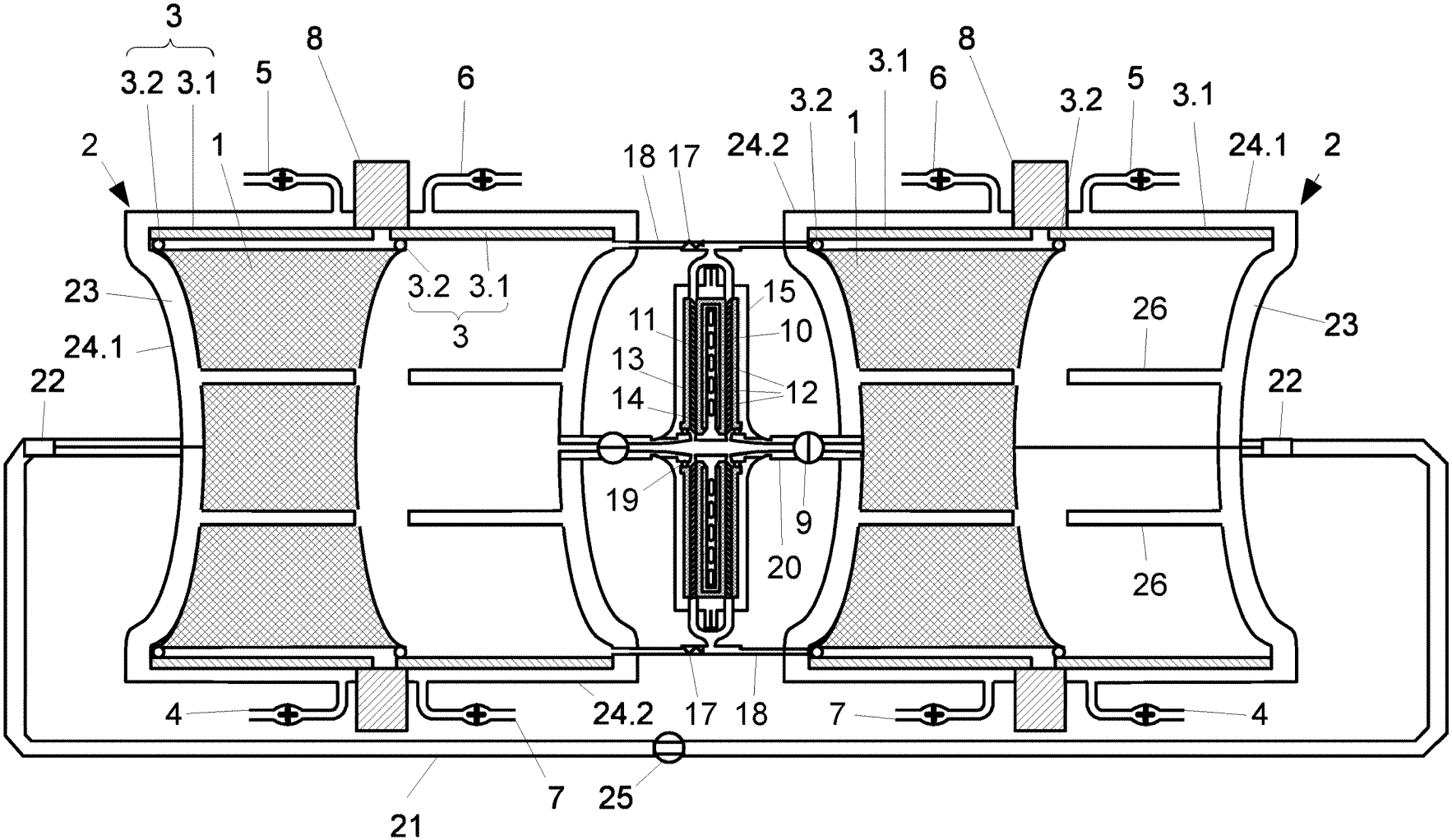
FIG. 1 is a partial longitudinal-sectional view of a heat cycle machine constructed in accordance with an embodiment of the present disclosure and depicting a block-type thermal power station.

The heat cycle machine according to FIG. 1 comprises the two cylinder-shaped chambers 2, the end walls of which are curved in order to increase strength (at high internal pressures). In addition, the end walls of the chambers 2 exhibit the rod-shaped bulges 26 protruding into the interior of the chamber 2. In each of the chambers 2, the gas-permeable displacement piston 1 consisting of regenerator material is arranged being supported by means of the bearing 3. The bearing 3 comprises the wheels 3.2 and the rails 3.1. The housing of each chamber 2 is designed to be double-walled, so that the cavity 23 is formed, wherein two partial housings 24.1 and 24.2 each having its own cavity 23 are formed by the insulation and sealing layer 8. The first partial housing 24.1 exhibits the hot oil supply line 4 and the hot oil return line 5, so that hot oil can be passed through the cavity 23 of the first partial housing 24.1. The second partial housing 24.2 exhibits the cold water supply line 7 and the cold water return line 6, so that cold water can be passed through the wall, i.e. the cavity 23 formed inside the wall, of the second partial housing 24.2. The water may be used for space heating.

The working rotor 13 arranged within the rotor housing 15 comprises the flow channels 10 and the permanent magnets 11. The stator 14 comprises the induction coils 12. The working rotor 13 is rotatable mounted on the working gas discharge line 20 by means of the rolling bearings 19. At the position at which the working gas exits from the flow channels 10 of the working rotor 13, the openings (i.e. cut-outs) 16 are introduced into the working gas discharge line 20. The working gas discharge line 20 can in each case be closed or opened with the shut-off valve 9 placed between the chamber 2 and the working rotor 13.

Twenty-four working gas feed lines 18 are guided from each of the chambers 2 to the rotor housing 15, wherein in each case the working gas inflow from the respective chamber 2 to the working rotor 13 can be opened and interrupted by the other chamber 2 by means of a shuttle valve 17.

The two displacement pistons 1 are connected via the hydraulic line 21, in which the two thrust pistons 22, each of which is rigidly connected to a displacement piston 1, can be moved back and forth. Thus, the displacement pistons 1 are coupled to one another in their movement sequence. In order to increase the dwell time of the displacement pistons 1 at their respective end positions, the hydraulic line 21 can be quasi "blocked" by the shut-off valve 25.

Figure 2B:
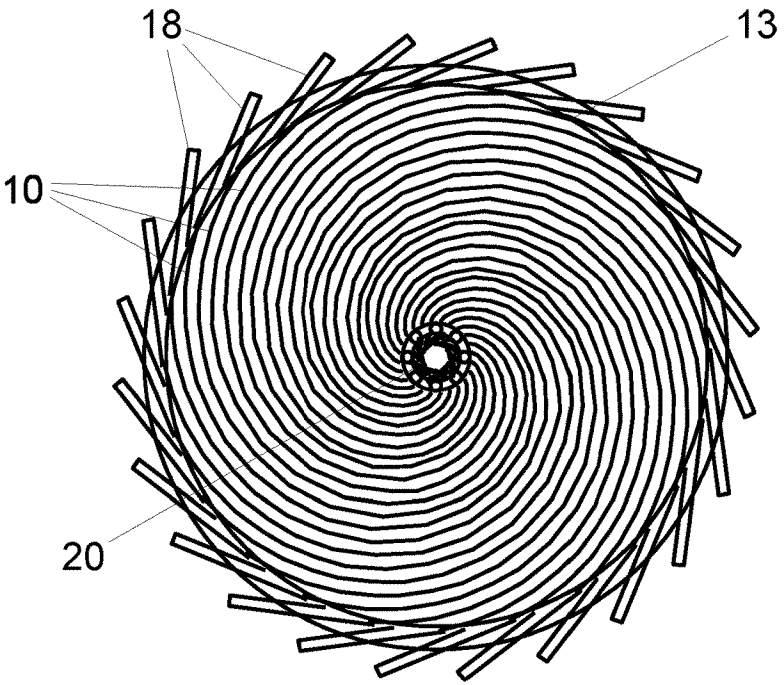
FIG. 2*b* is a longitudinal view of a working rotor constructed in accordance with an embodiment of the present disclosure.
Figure 2A:
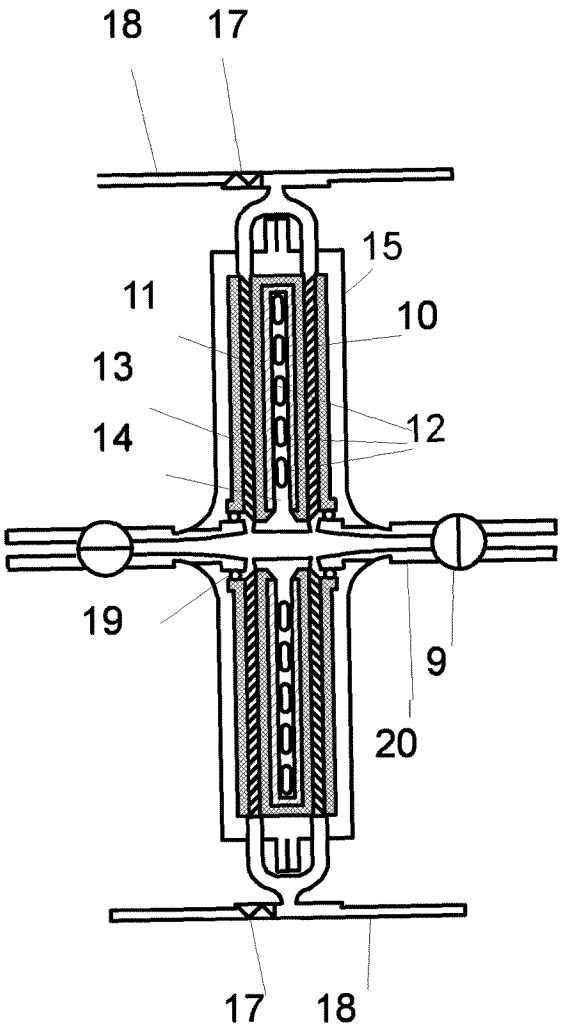
FIG. 2*a* is a cross-sectional view of a working rotor constructed in accordance with an embodiment of the present disclosure.

FIG. 2 shows the working rotor 13 in its rotor housing 15 according to FIG. 1 in cross-sectional view (FIG. 2*a*) in detail and in longitudinal section (FIG. 2*b*). In particular, the flow channels 10 which run spirally from the outside to the center (i.e, the axis of rotation) can be seen in the longitudinal-sectional view.

Figure 3B:
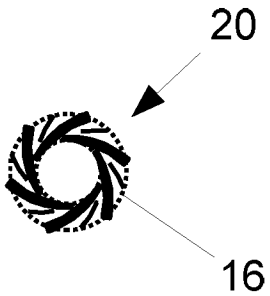
FIG. 3*b* is a cross-sectional view of a working gas discharge line constructed in accordance with an embodiment of the present disclosure.
Figure 3A:
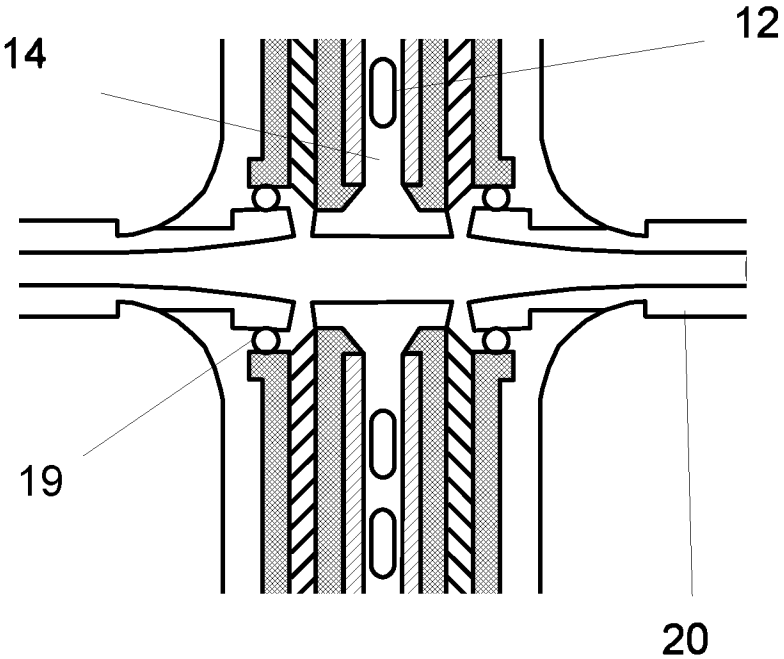
FIG. 3*a* is a longitudinal view of a working gas discharge line constructed in accordance with an embodiment of the present disclosure.

In FIG. 3*a*, the longitudinal section of the working gas discharge line 20 is enlarged, and FIG. 3*b* shows a cross section through the working gas discharge line 20 in the region of the openings 16. The openings 16 are introduced spirally from the outside in the direction of the center of the working gas discharge line 20, so that they are quasi designed as an extension of the spiral flow channels 10 of the working rotor 13.

LIST OF REFERENCE NUMERALS

1 displacement piston
2 chamber
3 bearing for displacement piston
3.1 rail
3.2 wheel
4 hot oil supply
5 hot oil return
6 cold water return/heating supply line
7 cold water supply/heating return line
8 insulating and sealing layer
9 shut-off valve of the working gas discharge line
10 flow channel
11 permanent magnet
12 induction coil
13 working rotor
14 stator
15 rotor housing
16 opening (laminar profile)
17 shuttle valve
18 working gas supply line
19 rolling bearing
20 working gas discharge line
21 hydraulic line
22 thrust piston
23 cavity
24.1 (first) partial housing
24.2 (second) partial housing
25 shut-off valve
26 bulge

The invention claimed is:

1. Heat cycle machine in which heat can be converted into electrical energy by means of a working rotor (13) that can be driven by a working gas, the heat cycle machine comprising a chamber arrangement comprising two cylinder-shaped chambers (2) of essentially identical capacity, wherein each of said chambers (2) is enclosed by a double-walled chamber housing, said double-walled chamber housing comprising an inner and an outer enclosure wall, and said chamber housing consisting of two partial housings (24.1, 24.2) being thermally insulated against each other, wherein each of said partial housings (24.1, 24.2) exhibits a cavity (23) formed between the inner and the outer enclosure walls of the respective partial housing (24.1, 24.2), and wherein each of said partial housings (24.1, 24.2) comprises a heat fluid inlet and a heat fluid outlet at its respective outer enclosure wall, the heat fluid inlet allowing for introducing a heat fluid into the cavity (23) formed between the inner and the outer enclosure wall of the respective partial housing (24.1, 24.2), and the heat fluid outlet allowing for draining the heat fluid from the cavity (23);

for each chamber (2) at least one working gas supply line (18) and at least one working gas discharge line (20), said at least one working gas supply line (18) and at least one working gas discharge line (20) connecting the respective chamber (2) to a rotor housing (15), said rotor housing (15) enclosing the working rotor (13), characterized in that a displacement piston (1) permeable to a working gas is movably arranged inside each of the chambers (2), wherein a diameter of said displacement piston (1) is smaller than an inner diameter of the respective chamber (2);

the two cylinder-shaped chambers (2) are connected to each other by a hydraulic line (21) closable by means of a shut-off valve (25), wherein the hydraulic line (21) is connected to each chamber (2) at one of the end faces of the respective chamber (2) and;

each of the displacement pistons (1) is rigidly connected to a thrust piston (22) movably arranged in the hydraulic line, wherein the thrust pistons (22) tightly fit the inner wall of the hydraulic line (21);

the working gas discharge line (20) is a hollow cylinder running between the two chambers (2) along the rotation axis of the working rotor (13), the working rotor (13) being seated rotably on the hollow cylinder; and a hermetically sealed working gas space is formed by the chambers (2), the thrust pistons (22), the at least one working gas supply line (18), the at least one working gas discharge line (20) and the rotor housing (15).

2. Heat cycle machine according to claim 1, characterized in that the displacement piston (1) is movably mounted within the respective chamber (2) by means of three rails (3.1), which are arranged at the inner wall of the first partial housing (24.1), and by three rails (3.1), which are arranged at the inner wall of the second partial housing (24.2).

3. Heat cycle machine according to claim 1, characterized in that the working rotor (13) comprises two pairs of circular plates arranged parallel to each other, wherein flow channels (10) are formed between the plates of each pair of plates, the flow channels (10) extending spirally from the outer edge to the center of the plates.

4. Heat cycle machine according to claim 3, characterized in that a stator (14) shaped as a circular plate is arranged between the two pairs of circular plates of the working rotor (13), wherein permanent magnets (11) are arranged on each pair of circular plates of the working rotor (13) and wherein induction coils (12) are arranged within the stator (14).

5. Heat cycle machine according to claim 3, characterized in that the working rotor (13) is seated on the working gas discharge line (20) by means of at least two rolling bearings (19), wherein the wall of the working gas discharge line (20) exhibits openings (16) in regions located between the two plates of each pair of circular plates of the working rotor (13), the openings (16) extending spirally from the outer wall to the inner wall.

6. Heat cycle machine according to claim 3, characterized in that the number of working gas supply lines (18), which are running from each of the chambers (2) to the rotor housing (15), is equal to the number of flow channels (10) extending spirally from the outer edge of each pair of plates of the working rotor (13) to the center.

7. Heat cycle machine according to claim 1, characterized in that each chamber (2) comprises 24 connectors to connect the working gas supply lines (18) to the rotor housing (15), wherein said connectors are arranged evenly spaced along a circle on the front wall of the chamber (2).

8. Heat cycle machine according to claim 1, characterized in that the inside of each chamber (2) facing the working gas space has a roughened surface.

9. Heat cycle machine according to claim 1, characterized in that the inner enclosure walls of the chambers (2) exhibit bulges through which the heat fluid can flow, said bulges (26) emanating from the front faces and reaching into the respective chamber (2), wherein the displacement piston (1) exhibits recesses at the respective positions, the recesses having a size and shape corresponding to a size and shape of the bulges (26).

10. Heat cycle machine according to claim 1, characterized in that the displacement pistons (1) essentially consist of an open-pored metal or ceramic foam, the pore size of which steadily decreases from the edge to the center.

* * * * *